US005127360A

United States Patent [19]

Ifkovits et al.

[11] Patent Number: 5,127,360

[45] Date of Patent: Jul. 7, 1992

[54] ENVELOPE MARKING APPARATUS

[75] Inventors: Edward M. Ifkovits, New Fairfield; John J. Mercede, Jr., Easton, both of Conn.

[73] Assignee: Pitney Bowes Inc., Stamford, Conn.

[21] Appl. No.: 576,818

[22] Filed: Sep. 4, 1990

[51] Int. Cl.[5] ..... B05C 1/10

[52] U.S. Cl. ..... 118/244; 118/264; 118/258; 101/331

[58] Field of Search ..... 401/220, 219, 197, 218; 118/244, 264, 258, 252, 241, 243; 101/328, 331

[56] References Cited

U.S. PATENT DOCUMENTS 2,349,455 5/1944 Olson ..... 118/243
3,238,870 3/1966 Matkovich ..... 401/197

FOREIGN PATENT DOCUMENTS 2078175 1/1982 United Kingdom .

*Primary Examiner*—W. Gary Jones
*Assistant Examiner*—Brenda Lamb
*Attorney, Agent, or Firm*—Charles R. Malandra, Jr.; David E. Pitchenik; Melvin J. Scolnick

[57] ABSTRACT

Apparatus for marking an edge of an envelope moving in a first, substantially horizontal plane. The apparatus includes: a supporting arm; a mechanism for simultaneously rotating the arm in a second plane substantially parallel to the first plane and translating the arm perpendicular to the second plane; and a marker for applying ink to the envelope edge secured to the supporting arm. The marker includes a roller for contacting the envelope edge, a reservoir for storing a supply of ink, and a device for feeding the ink from the reservoir to the roller, whereby at an appropriate time the marker may be rotated and translated from a nonmarking position into a marking position adjacent the envelope edge for marking the envelope edge.

4 Claims, 3 Drawing Sheets

Fig. 6.
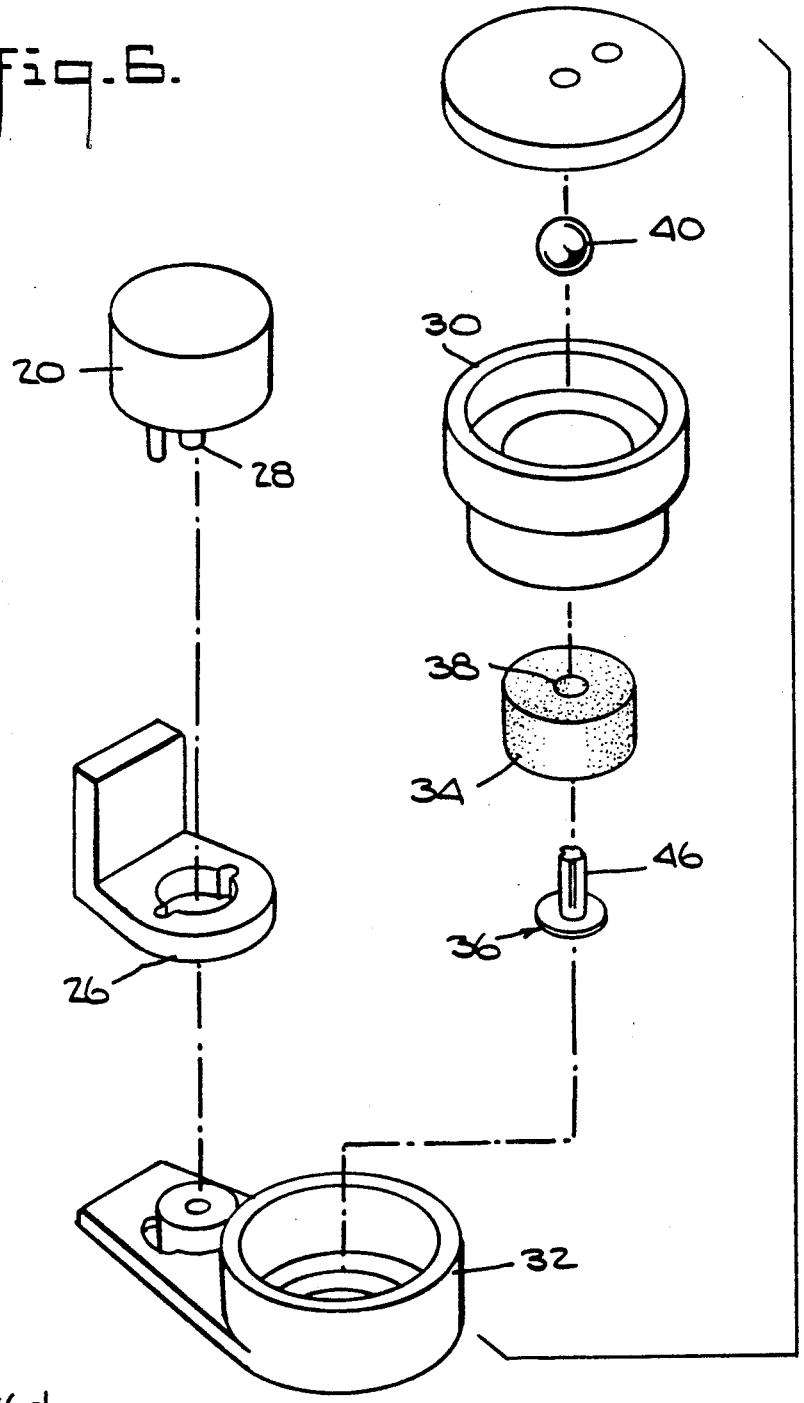
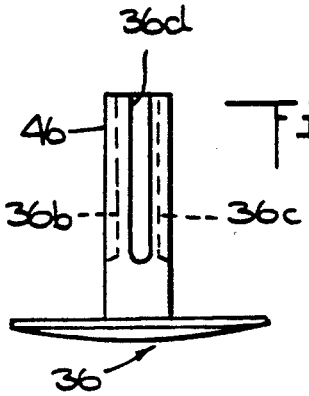
Fig. 7.
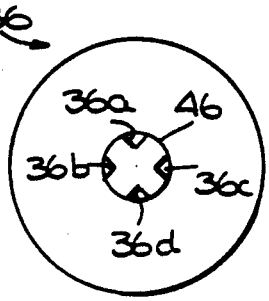
Fig. 8.

ENVELOPE MARKING APPARATUS

BACKGROUND OF THE INVENTION

The instant invention relates to apparatus for marking the edge of an envelope, and more particularly to such apparatus which is movable between a marking and non-marking position.

The use of envelope inserting machines to insert a plurality of documents into an envelope is well known. After the envelopes emerge from the inserting apparatus, they are moistened and sealed preparatory to further processing, which typically includes separating the envelopes into groups based on zip code. One means of separating the envelopes is to identify the first of a group of envelopes which are to be grouped together, and then to mark that envelope. Obviously, the apparatus used to mark the envelopes must not interfere with the travel of the envelopes, and this requires that the marking apparatus be movable between a marking and non-marking position. Marking of envelopes is also useful when it is desired to identify envelopes which are miscollated or overweight or mismarked or have other defects requiring separation from the stream of envelopes being processed. It is known to use different color ink for different defects in the envelopes.

The prior art envelope marking devices require that they be wetted with ink prior to each day's operation because they lack a reservoir for storing a supply of ink which is transferred to a marking roller. The instant invention accordingly overcome the problem associated with the prior art marking devices by providing an envelope marking device which includes a reservoir and which is movable between a marking and non-marking position with respect to a path for moving envelopes.

SUMMARY OF THE INVENTION

Accordingly, the instant invention provides apparatus for marking an edge of an envelope moving in a first, substantially horizontal plane. The apparatus comprises: a supporting arm; means for simultaneously rotating the arm in a second plane substantially parallel to the first plane and translating the arm perpendicular to the second plane; and a marker for applying ink to the envelope edge secured to the supporting arm. The marker includes a roller for contacting the envelope edge, a reservoir for storing a supply of ink, and means for feeding the ink from the reservoir to the roller, whereby at an appropriate time the marker may be rotated and translated from a nonmarking position into a marking position adjacent the envelope edge for marking the envelope edge.

BRIEF DESCRIPTION OF THE DRAWINGS

FIG. 6 is an exploded, perspective view of the marker seen in FIG. 3;

FIG. 7 is a side, elevational view of the orifice member of the reservoir assembly seen in FIGS. 4 and 5;

FIG. 8 is a top plan view of the orifice member seen in FIG. 7.

DETAILED DESCRIPTION OF THE PREFERRED EMBODIMENT

Figure 1:
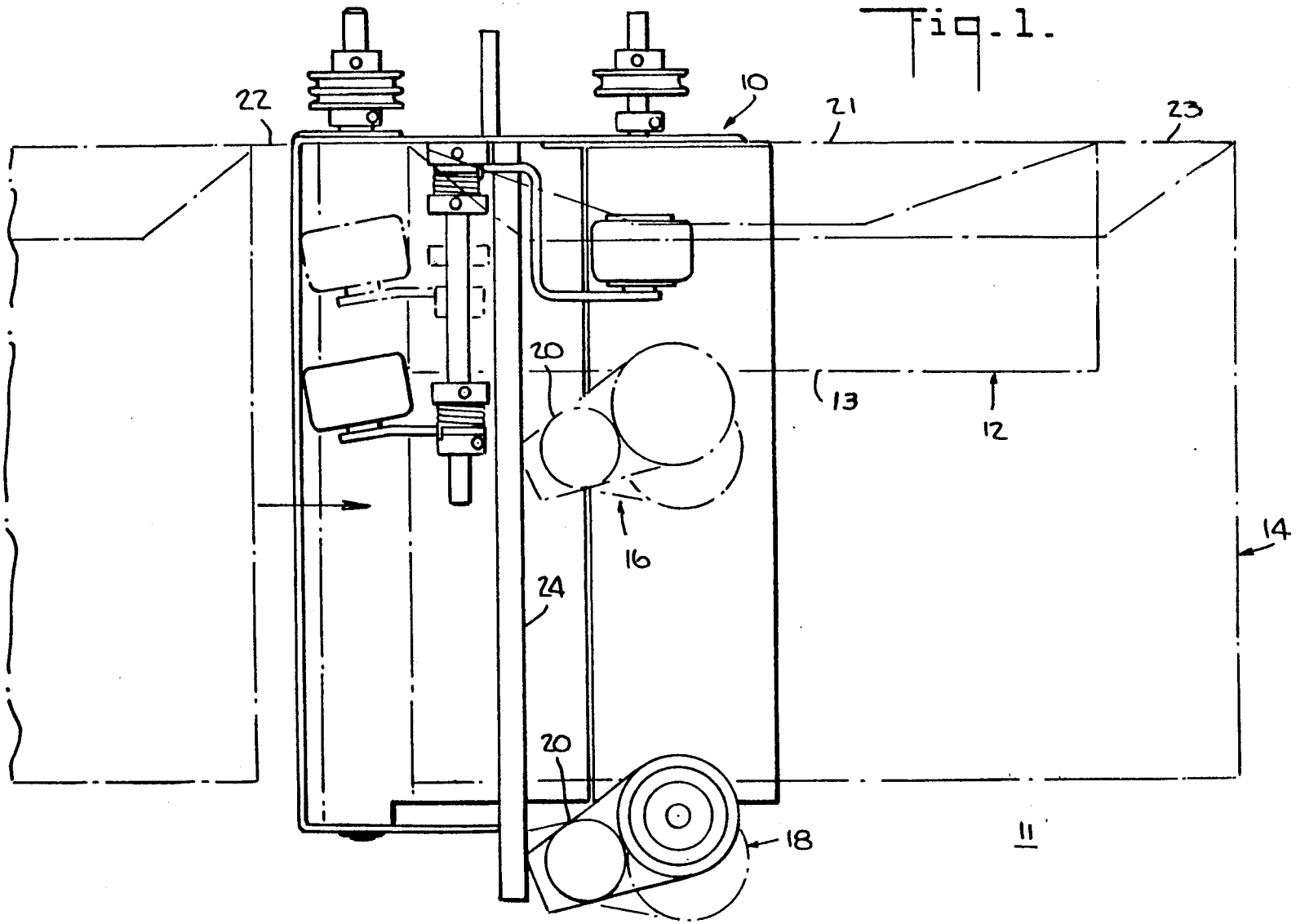
FIG. 1 is a top, plan view of an envelope transport device utilizing an envelope marking device in accordance with the instant invention.
Figure 2:
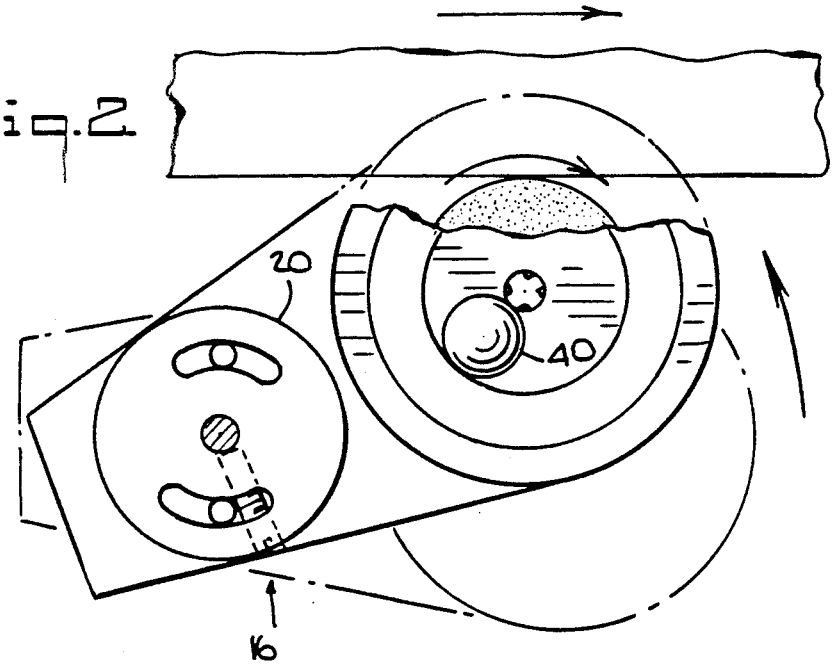
FIG. 2 is a top, plan view of the envelope marker seen in FIG. 1 showing the marking and non-marking positions of the marker.

In describing the preferred embodiment of the instant invention, reference is made to the drawings, wherein there is seen in FIG. 1 an envelope transport device generally designated 10 which includes a transport deck 11 for moving a sealed envelope 12 along the transport deck 11 toward other apparatus for further processing of the envelope 12. As seen in FIG. 1, the transport device 10 can accommodate a larger envelope 14. It is to be understood that the envelopes are transported sequentially along the transport deck 11; however, for purposes of illustration only, FIG. 1 shows two overlying envelopes. A marking unit 16 for marking the smaller envelopes 12 and a marking unit 18 for marking the larger envelopes 14 are secured in two different locations, as seen in FIG. 1, to the transport device 10. The marking unit 16 has an inner location which permits the marking of $4 \times 12$ envelopes, while the marking unit 18 has an outer location which permits the marking of $9 \times 12$ envelopes.

The markers 16 and 18 have two positions, both of which are seen in FIG. 1. The idle position is the retracted position, remote from the envelopes 12 and 14, which is the de-energized position of the rotary solenoid 20. As seen in FIG. 1, the envelopes 12 and 14 are positioned such their uppermost edges 21 and 23 respectively are registered against the wall 22 while the envelopes 12 and 14 are in transit past their respective markers 16 and 18. Each of the markers 16 and 18 is adjustable along a rail 24 which is part of the transport device 10. The markers 16 and 18 are clamped to the rail 24 by conventional means, and are comprised of a number of components, which will be described hereinbelow with reference to the marker 16, it being understood that the marker 18 is identical to the marker 16.

As best seen in FIG. 6, the marking unit 16 includes a basic support member 26 which holds the rotary solenoid 20. The solenoid 20 includes a rotor 28 which rotates through a pre-determined angle corresponding to a desired position of operation called the marking position. While the angular motion occurs, the rotor 28 also moves axially a predetermined distance of 0.093 inches.

The marker 16 is designed to hold ink in a reservoir 30 which is supported by an arm 32 which is keyed and suitably fastened to the rotor 28. The reservoir 30 is comprised of a number of parts which are assembled together to provide a replaceable assembly in the event another color ink is desired in the marking operation. There is a felt roller 34 and a four-orifice chamber 36 which fits snugly into an aperture 38 of the roller 34.

Figure 3:
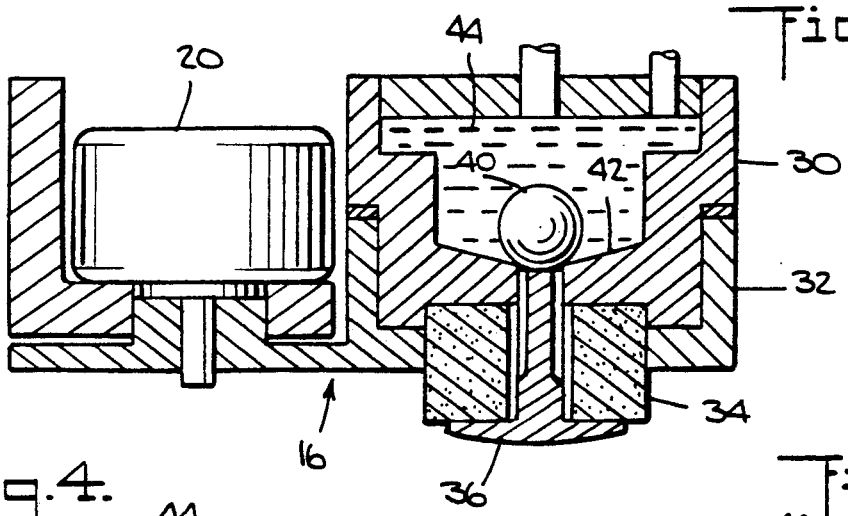
FIG. 3 is a central, vertical, sectional view of the marker seen in FIG. 2 in the non-marking position.

As best seen in FIG. 3, the marker 16 includes a valve ball 40 which normally sits at the bottom 42 of the reservoir 30 when the marker 16 is in the idle position. The reservoir bottom 42 is conically shaped. When the marker 16 is loaded with ink 44 in the reservoir 30, the ink 44 will be at the level seen in FIGS. 3–5 which covers the ball 40. When the marker 16 is in the idle position remote from the envelope 12 (see FIGS. 1, 3 and 5), the ball 40 is in the seal position, thereby covering the ink flow chamber 36 which contains four slots 36*a*, 36*b*, 36*c* and 36*d* as best seen in FIG. 8. The slots 36*a–d* are cut into the stem 46 of the chamber 36. The ink 44 will flow down through the aperture 38 and proceed through the slots 36*a–d* until it permeates the roller 34.

Figure 4:
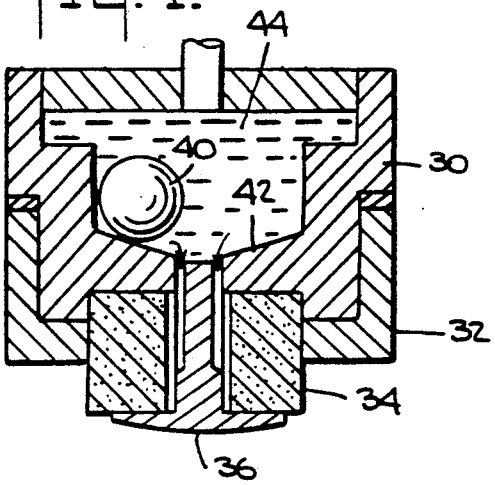
FIG. 4 is a central, vertical sectional view of the reservoir assembly of the marker seen in FIG. 3 when the marker is in the marking position.
Figure 5:
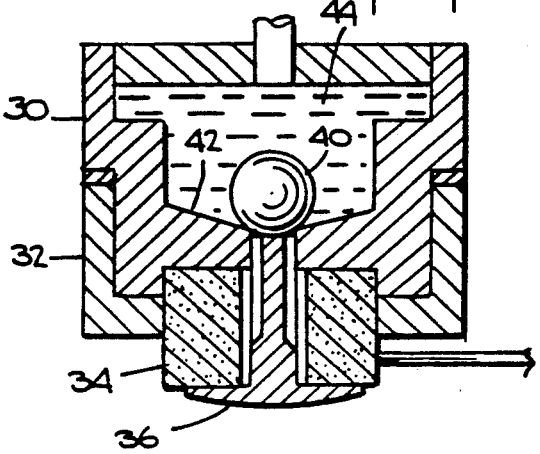
FIG. 5 is similar to FIG. 4 but shows the reservoir assembly when the marker is in the non-marking position.

When the marker 16 is energized, the reservoir 30, the roller 34 and the chamber 36 rotate together toward the marking position by virtue of the arm 32 being pushed over to the marking position adjacent the envelope 12 as seen in FIG. 1. The assembly consisting of the aforesaid parts and the arm 32 moves downwardly 0.093 inches toward the transport deck 11 in order to bring the marker 16 out of its elevated position with respect to the deck 11 where the marker 16 does not interfere with the flow of the envelopes 12, 14 etc. During the angular motion of the arm 32, the ball 40 moves from the center of the bottom 42 of the reservoir 30 (see FIGS. 3 and 5) to a position remote from the center, as seen in FIG. 4, thereby allowing a limited amount of ink 44 to enter the underlying four slots 36*a–d* and to reach the roller 34.

When contact is made between the roller 34 and the envelope 12 as a result of the envelope 12 being translated along the transport deck 11, the engagement causes the roller 34 and all related parts, including the reservoir 30, to rotate during the actual inking of the envelope 12, which occurs only at the trailing portion of the lowermost edge 13. A return bias spring (not shown) inside the solenoid 20 brings the marker arm 32 back to the idle position remote from the envelope 12 after the marking of the envelope edge 13 has been completed. This process is typical of marking envelopes for "zip code break".

The ball 40 always returns via gravity to rest in the position seen in FIG. 3 at the bottom of the reservoir 30 when the marker 16 is in the idle position since the reservoir 30 has a slightly inclined bottom surface 42. Whenever the supporting arm 32 rotates toward the marking position adjacent the envelope lowermost edge 13, under the influence of the solenoid 20, the ink 44 in the reservoir 30 drips down the slots 36*a–d* from which it then permeates the felt roller 34.

It should be understood by those skilled in the art that various modifications may be made in the present invention without departing from the spirit and scope thereof, as described in the specification and defined in the appended claims.

What is claimed is:

1. Apparatus for marking an edge of an envelope moving in a first, substantially horizontal plane, comprising:

a support arm;

a solenoid having a rotor, operatively connected to said arm, said solenoid being able to rotate said rotor through a predetermined angle and translate said rotor axially a predetermined distance during rotation of said rotor; and a marker for applying ink to said envelope edge secured to said support arm, said marker having a roller for contacting said envelope edge, a reservoir for storing a supply of ink, and means for feeding said ink from said reservoir to said roller, whereby at an appropriate time said marker may be rotated and translated into a marking position adjacent said envelope edge for marking said envelope edge.

2. The apparatus of claim 1, wherein said ink feeding means includes a multi-orifice chamber which fits through an aperture in said roller.

3. The apparatus of claim 2, wherein the reservoir includes a conically shaped lower surface.

4. The apparatus of claim 3, wherein the reservoir additionally includes a valve ball which normally sits at the center of the bottom of the reservoir when the marker is in the nonmarking position and thereby covers said multi-orifice chamber, and which moves away from said center when said marker is moved into marking position to thereby allow ink to flow to said roller.

* * * * *